US005320291A

United States Patent [19]

Glover et al.

[11] Patent Number: 5,320,291

[45] Date of Patent: Jun. 14, 1994

[54] PUMP DISPENSER HAVING A RESILIENT RESERVOIR AND PUMPING CHAMBERS

[75] Inventors: Paul A. Glover, Loughborough; Brian R. Law, Leicester, both of England

[73] Assignee: Chesebrough-Pond's USA Co., Greenwich, Conn.

[21] Appl. No.: 11,012

[22] Filed: Jan. 29, 1993

[30] Foreign Application Priority Data

Jan. 31, 1992 [GB] United Kingdom ..... 9202150

[51] Int. Cl.[5] ..... B05B 5/035; B05B 9/04

[52] U.S. Cl. ..... 239/708; 239/333; 222/190; 222/207; 222/509

[58] Field of Search ..... 239/690, 708, 329, 333, 239/569-572, 574, 579, 537, 541, 327, 328; 222/207, 509, 505, 190

[56] References Cited

U.S. PATENT DOCUMENTS

| | | | |
|---|---|---|---|
| 3,239,151 | 3/1966 | Jokelson | 239/333 |
| 3,387,789 | 6/1968 | Fedit et al. | 239/333 |
| 3,406,909 | 10/1968 | Pfeiffer | 239/333 |
| 4,088,425 | 5/1978 | Bennett | 417/444 |
| 4,322,020 | 3/1982 | Stone | 222/95 |
| 4,402,431 | 9/1983 | Wiegner et al. | 222/207 |
| 4,801,046 | 1/1989 | Miczka | 222/95 |
| 4,936,492 | 6/1990 | Amiel et al. | 222/207 |
| 5,205,441 | 4/1993 | Andris | 222/207 |
| 5,221,050 | 6/1993 | Jeffries et al. | 239/708 |

FOREIGN PATENT DOCUMENTS

| | | |
|---|---|---|
| 0000313 | 1/1979 | European Pat. Off. . |
| 2128900 | 5/1984 | United Kingdom . |

*Primary Examiner*—Karen B. Merritt
*Attorney, Agent, or Firm*—Milton L. Honig

[57] ABSTRACT

A fluid dispenser is provided including a reservoir for a fluid material, at least one sealable chamber capable of receiving material from the reservoir, a closure valve device between the chamber and a fluid outlet from the dispenser and a pumping device for pressurizing any fluid material in the chamber, the chamber including at least one resilient wall portion arranged to be deformed by pressurizing of the fluid material.

9 Claims, 3 Drawing Sheets

PUMP DISPENSER HAVING A RESILIENT RESERVOIR AND PUMPING CHAMBERS

BACKGROUND OF THE INVENTION

1. Field of the Invention

This invention relates to dispensers for fluid materials. It is particularly concerned with pumping acting dispensers from which the material is ejected as a spray.

2. The Related Art

Aerosols are commonly used to spray a fluid material under pressure from a dispenser but suffer from a number of disadvantages, including the adverse environmental effect of the propellant gases used, the high proportion of the total capacity of the dispenser that is sometimes needed for the propellant, and the difficulty of maintaining the spray pressure as the contents of the dispenser are used up. The disposal of the partly empty dispensers can also be a hazard because of the pressurized gases they contain. The present invention is concerned with a novel form of dispenser in which at least some of these disadvantages can be avoided.

SUMMARY OF THE INVENTION

According to one aspect of the invention, there is provided a fluid dispenser comprising a reservoir for a fluid material, at least one sealable chamber capable of receiving material from the reservoir, closure valve means between the chamber and a fluid outlet from the dispenser, and pumping means for pressurizing any fluid material in the chamber, the chamber comprising at least one resilient wall portion arranged to be deformed by the said pressurization of the material.

The pumping means may comprise a manually displaceable operating member. Displacement of the operating member to pressurize the chamber contents can thus initiate a discharge of the fluid under pressure and simultaneously cause said at least one wall portion to deform and distend the chamber, the resilience of said wall portion then providing a force for maintaining ejection of the fluid material from the chamber under pressure.

By these means it is possible to arrange, without relying on a propellant gas, that fluid can be ejected from the dispenser in a pulse at a relative uniform pressure, so that a spray of the material can be maintained longer. If the user displaces the manual operating member rather abruptly, the pressure rise in the chamber and the initial delivery rate of the fluid will be tempered by the deformation of said resilient wall portion. Even if the operating member is displaced sharply to the end of its travel, the resilient deformation of said at least one wall portion can maintain the ejection pressure for a further period of time.

Preferably, displacement of the manual operating member is arranged also to open the closure valve between the chamber and a fluid outlet from the dispenser. The flow driven by pressure from the deformed wall portion can then be maintained simply by holding the manual operating member in its displaced position. For better control of the spray, it is preferred to arrange that any remaining pressure in the chamber is released when the manual operating member is returned from its displaced position and the outlet valve closed.

The at least one flexible wall portion may comprise a diaphragm on which the closure valve is carried so that both are displaced jointly.

In a preferred arrangement, the pumping means comprises two pressure chambers arranged in series, a pressure being generated in a first of the chambers by initial displacement of the valve from its closure position and the second chamber being pressurized by displacement of the diaphragm to eject fluid material through the first chamber.

According to another aspect of the invention, there is provided a fluid dispenser comprising a reservoir for a fluid material, pumping means for ejecting material from the reservoir through a fluid outlet of the dispenser, the pumping means comprising a first chamber having an outlet valve communicating with the fluid outlet, a second chamber between the first chamber and the reservoir, and non-return valve means between the reservoir and the second chamber, and between the first and second chambers, the non-return valve means comprising a flexible valve member having integral first and second sealing elements for closure of the respective inlets of the first and second chambers.

Such an arrangement can provide a relatively simple and easily manufactured construction, especially for small devices such as hand-held dispensers, in contrast to the ball valves that are often employed in these devices. The valve member can also be so arranged as to present relatively large fluid passages when either inlet is opened, so reducing pressure losses in the fluid flow.

A further aspect of the invention is concerned with dispensers which produce a spray the deposition of which can be controlled by creating an electrostatic charge between the spray and a surface on which it is to be deposited. Such a dispenser, in accordance with this aspect of the invention, comprises a flexible reservoir for a fluid material, a closure valve for sealing the reservoir, a delivery chamber between the valve and the flexible reservoir, pumping means for pressurizing fluid material in the chamber and an operating member for opening the valve and actuating the pumping means, whereby the pressurized material is dispensed through a spray outlet when the operating member is operated, the dispenser further comprising voltage generating means actuatable by the operation of the member to apply an electrostatic charge to the material being dispensed.

BRIEF DESCRIPTION OF THE DRAWING

By way of example, the accompanying drawings illustrate one form of dispenser according to the invention. In the drawings.

DETAILED DESCRIPTION

Figure 1:
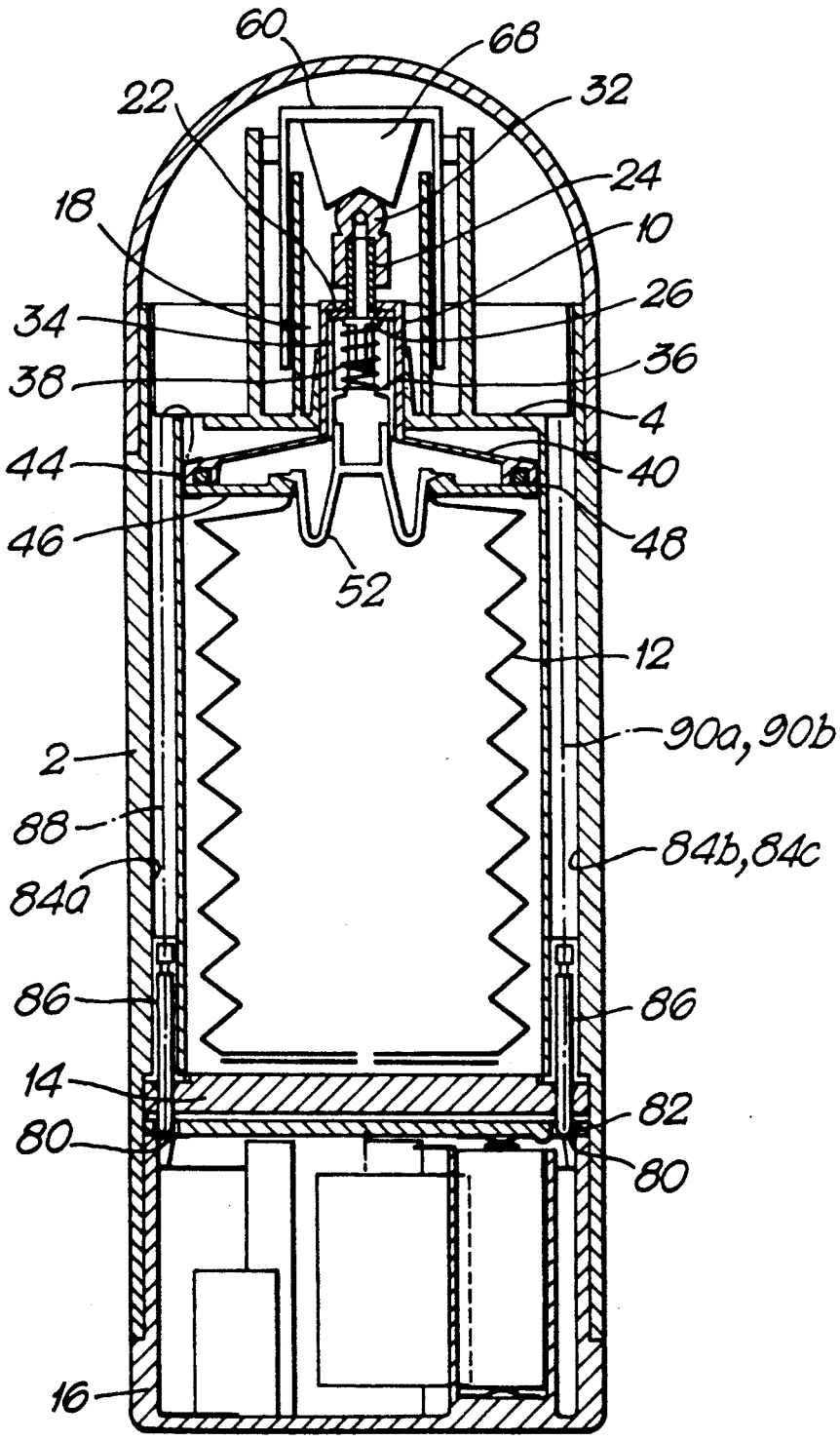
FIGS. 1 and 2 are mutually transverse axial sections of the dispenser.
Figure 2:
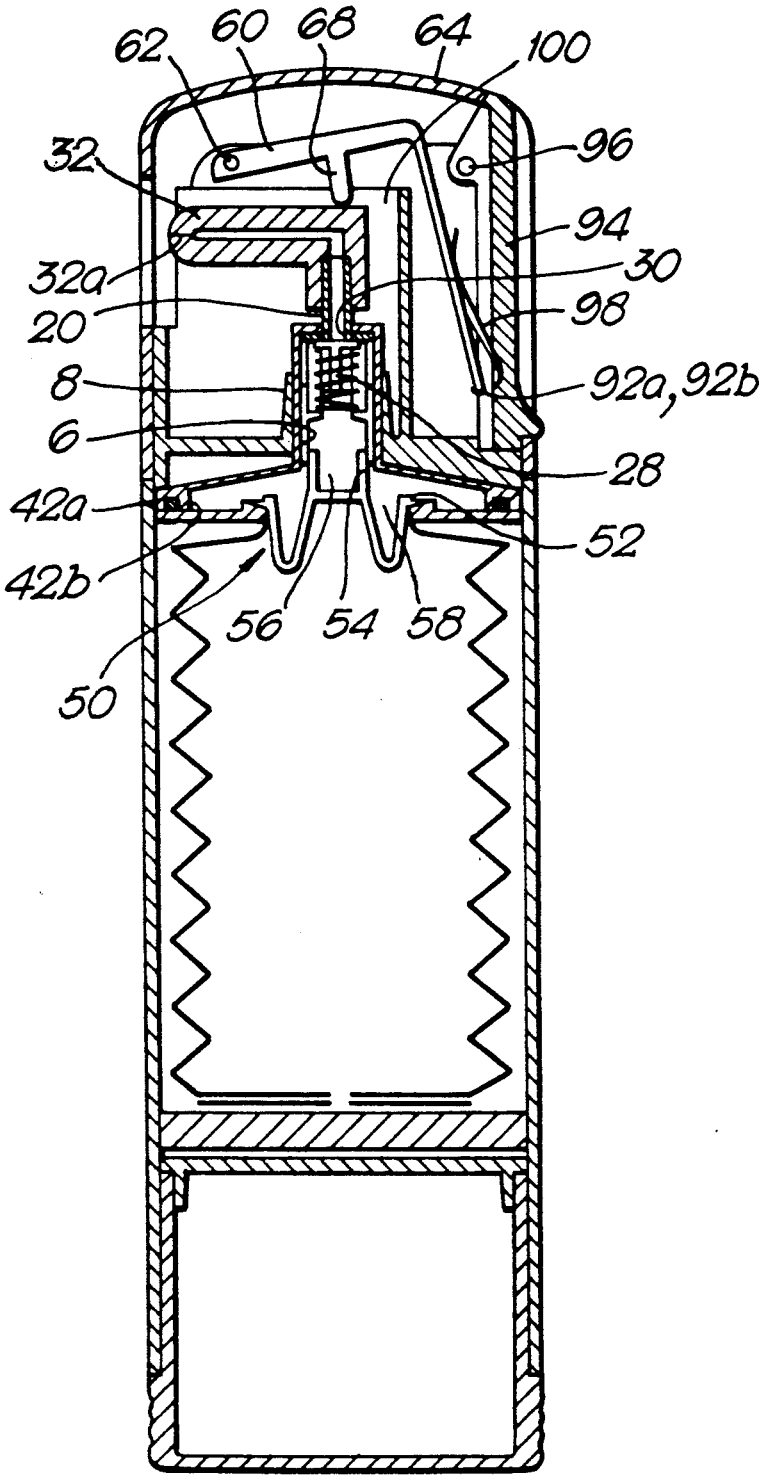
Figure 3:
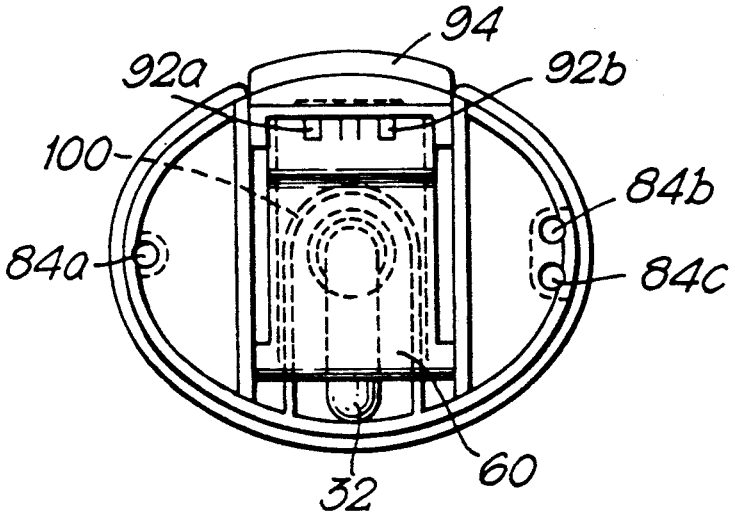
FIG. 3 is a top plan view with the top cap of the dispenser casing omitted.

The dispenser illustrated comprises an outer casing 2 having an integrally formed transverse partition 4 with a central aperture 6. A cylindrical support flange 8 extends upwards from the edge of the aperture 6 to provide a guide for a valve housing 10 at the top of a closed bellows-form container 12 which is filled with the fluid material to be dispensed. Below an end wall 14 in the lower part of the casing there is an electrical power pack 16. The power pack can be slid into the open bottom end of the casing and a circumferential rib (not shown) on the periphery of the pack locks into a complementary recess (not shown) in the casing wall to secure the power pack releasably.

The valve housing 10 contains a normally closed outlet valve 18 for the container contents. The valve is in the form of a conventional aerosol valve in which a valve body 20 projects through a central opening of the cap-like housing and engages an elastomeric annular seal 22 surrounding the housing opening to maintain the outlet closed. The valve body comprises an upper tubular portion 24 and a lower guide stem 26 between which is a collar portion 28 urged against the seal. The seal also engages the outer periphery of the tubular portion which has cross bores 30 to its interior immediately above the collar portion. A spray nozzle 32 is secured to the upper end of the tubular portion 24. The seal is held in place by a tubular liner 34 which comprises an inwardly projecting shoulder 36. A compression spring 38 between the shoulder and the valve body collar portion 26 provides the biasing force which holds the collar portion against the seal 22.

The valve housing is formed integrally with a flexible, conically shaped diaphragm 40 which has an outer rim comprising a pair of dependent cylindrical flanges **42*a*, 42*b* that hold an O-ring 44 between them. The O-ring seals against a relatively rigid end plate 46 which is formed integrally with the main body of the bellows container 12 and which is clamped against the flanges and O-ring by a metal C-band 48 crimped around the diaphragm rim and end plate. The bellows container 12 is located axially in the casing by a series of pips (not shown) on the casing inner wall over which the end wall 46** with its crimped C-band is snap-fitted.

The main interior volume of the bellows body is sealed from the interior of the valve housing by a flexible valve member 50 which has an annular sealing lip 52 engageable with a complementary upper face on an inner rim of the end plate 46. The valve member 50 also has an upwardly projecting sleeve 54 which engages the inner wall of the valve housing 10 to form a further seal so that mutually seated upper and lower pumping chambers 56,58 are defined respectively between the sleeve 54 and the housing 10. The sealing lip 52 can be flexed away from the end plate by a pressure differential to allow material to flow from the bellows body to the lower chamber 58 and the collar 54 can be similarly flexed away from the housing inner wall to allow material to flow from the lower chamber to the upper chamber 56.

An operating member 60 mounted on a pivot 62 in a top cap 64 forming part of the casing 2 is shown in its rest position with an integral contact bar 68 bearing without pressure on the spray nozzle 32 fixed to the valve body 20. When the member 60 is pivoted downwards the bar depresses the valve body against its spring bias. The collar portion 26 moves away from the seal 22 and the cross bores 30 in the tubular wall are brought into communication with the valve housing interior below the annular seal 22. The initial displacement of the valve body 20 reduces the volume of the upper chamber 56, pressurizing the material in it and sealing the valve sleeve 54 more firmly against the housing wall. Material from the chamber 56 is thus forced through the cross bores 30 and tubular portion 24 of the valve to be ejected under pressure through the nozzle 32.

After an initial movement of the valve body the lower end of the nozzle 32 comes into abutment with the valve housing 10 and further displacement of the operating member 60 then pushes the valve housing downwards with the valve maintained in its open state. This movement of the valve housing is accommodated by flexure of the diaphragm 40 and an increase of pressure in the lower chamber 58 while the contraction of the volume of the upper chamber 56 continues because the valve member 50 remains substantially stationary. Because of the increase of pressure in the lower chamber 58, the valve sleeve 54 is now forced away from the housing wall as the pressurized material flows from the lower chamber 58 into the upper chamber 56 and thence through the nozzle 32 to maintain the pressure spray.

It may be noted that the rate at which the operating member 60 is depressed has a limited effect on the rate of delivery of the fluid material. If the operating member is displaced faster than is necessary to maintain the spray, the diaphragm is increasingly flexed as the pressure rises. The operating member may now be held fixed in its displaced position and the delivery of fluid will continue as long as the focus of deformation of the diaphragm maintain a pressure differential between the chambers 56, 58 sufficient to hold the valve sleeve 54 open.

When the operating number is released, the resilience of the diaphragm 40 restores it to its original position and the expansion of the upper chamber 56 draws material back from the nozzle interior to ensure a sharp cut-off for the spray. The valve body 20 is returned by its spring 38 to the closure position. The return of the diaphragm also expands the lower chamber 58 which causes the valve lip 52 to lift from its seating as material is drawn into the chamber from the main body of the container, the bellows walls of which contract accordingly. The cycle of operation can now be repeated.

It is known that if an electrical charge are given to a spray and an object to be sprayed is earthed or grounded the spray particles are attracted to the object. The illustrated dispenser is intended to make use of such an effect for spraying personal products and is provided for this purpose with the power pack 16 which comprises a batter-powered circuit for generating a high voltage, e.g. 15 kV. Such circuits are well known and need not be further described here. However suitable examples may be found for example in EP501725 (Imperial Chemical Industries).

The circuit within the power pack is connected to a series of terminal plates 80 accessible through apertures 82 in the pack end wall. Tubular channels **84*a*, 84*b*, 84*c* integrally formed on the inner wall of the casing have spring-loaded contact pins 86 mounted in their lower ends and the pins project through the casing end wall to make contact with the terminal plates 80 when the power pack is in place. On one side of the casing there is the single channel 84*a* which encloses a high-voltage wire 88 in contact with the metal C-band 48. The end plate 46 has a metallised or metal foil surface in contact with the C-band 48. On the other side of the casing the pair of channels 84*b*, 84*c* contain respective wires 90*a*, 90*b* which are respectively attached to a pair of laterally spaced contacts 92*a*, 92*b* on the operating member 60**.

A metal press button 94 for pivoting the operating member is mounted on a pivot 96 adjacent the operating member but is normally held spaced from the member by a spring 98. When the button is depressed by the user to displace the operating member 60, as pressure begins to be applied to the nozzle 32 to produce the spray as already described, the spring 98 is flexed and the push button 94 bridges the two contacts **92*a*, 92*b***.

The contact the user makes with the metal push button 94 provides a ground for the high tension circuit which is connected to the metal surface of the end plate 46 and the material being sprayed from the chambers 56, 58 is thereby electrically charged. The nozzle 32 has a suitably small orifice 32*a*, e.g. 0.15 mm diameter, and the pressure forcing the material through it produces a spray in the form of a mist of very fine droplets. The high voltage electrostatic charge these now carry ensures that they are attracted towards that part of the body of the user to which the spray is directed since the user's body forms the ground for the circuit. The user is able in this way to obtain the full effect of the spray with minimum loss.

Because of the small droplet size and the effect of charging the droplets it is possible to use many personal products effectively in very small volumes. A rate of flow of the order of 2 ml per minute may be sufficient and a pump displacement volume of only about 1 ml is needed therefore to give a maximum spray period of 30 seconds before pressure must be released from the push button to recharge the pumping chambers.

Because of the relatively high voltages generated in the dispenser it is desirable to take precautions to keep the user shielded from the circuitry in it. Although the power levels can be kept small enough to ensure no danger will result from contact with the high voltage side, the voltage level is sufficient to give an unpleasant shock. In the illustrated example, a barrier plate 100 projecting from the partition separates the region of the press button from the region of the pumping chambers and outlet valve.

The high voltage wire 88 is located on the opposite side of the casing to the push button and it may be led out of the side wall of its conduit 84*a* below the partition 4 to isolate it from the opening in the cap 64 at the nozzle outlet.

We claim:

1. A fluid dispenser comprising:

a casing;

a reservoir within said casing for holding a fluid material;

a fluid outlet for dispensing said fluid material from said casing;

at least one sealable chamber capable of receiving said fluid material from said reservoir;

closure valve means for closing said fluid outlet positioned between said at least one sealable chamber and said fluid outlet, said valve means including a valve housing within which is a valve body collar portion surrounded by a compression spring;

pumping means for pressurizing any fluid material inside said at least one sealable chamber; and said chamber comprising at least one resilient wall portion arranged to be deformed by said pressurizing of said any fluid material, said resilient wall portion being positioned at an end of said valve housing below said compression spring and conically extending outward therefrom.

2. A fluid dispenser according to claim 1, wherein said pumping means comprises a manually displaceable operating member.

3. A fluid dispenser according to claim 2, wherein said manual operating member is arranged also to open said closure valve means between said at least one sealable chamber and said fluid outlet.

4. A fluid dispenser according to claim 1, wherein said at least one resilient wall portion comprises a diaphragm on which is located said closure valve means.

5. A fluid dispenser according to claim 4, wherein said pumping means comprises two of said at least one sealable chamber arranged in series.

6. A fluid dispenser according to claim 5, wherein said sealable chambers are arranged such that a pressure may be generated in a first of said sealable chambers by initial displacement of said closure valve means from an open to a closure position, and in said second sealable chamber by displacement of said resilient wall portion to eject said any fluid material through said first sealable chamber.

7. A fluid dispenser according to claim 1, additionally comprising an operating member for opening said valve means and actuating said pumping means, whereby pressurized material to be dispensed is dispensed through a spray outlet when said operating member is operated, said dispenser further comprising voltage generating means actuable by operation of said operating member to apply an electrostatic charge to material being dispensed.

8. A fluid dispenser according to claim 1, wherein said reservoir is in a bellows form and a wall of said at least one sealable chamber is common with said reservoir.

9. A fluid dispenser comprising:

a casing;

a fluid outlet for dispensing fluid material from said casing;

a flexible reservoir for said fluid material;

pumping means for ejecting fluid material from said reservoir comprising:

a first chamber having an outlet valve communicating with said fluid outlet;

a second chamber between said first chamber and said reservoir;

nonreturn valve means between said reservoir and said first chamber and between said first and second chambers, said nonreturn valve means comprising a flexible valve member having integral first and second sealing elements for closure of respective inlets of said first and second chambers; and said first and second chambers being formed with at least one resilient wall portion to be deformed by pressurization from said fluid material, said resilient wall portion conically extending outward towards walls defining said casing.

* * * * *